US010011330B2

(12) United States Patent
Osimo

(10) Patent No.: US 10,011,330 B2
(45) Date of Patent: Jul. 3, 2018

(54) RECREATIONAL FLOTATION DEVICE AND METHOD OF MANUFACTURING SAME

(71) Applicant: Aqua-Leisure Industries, Inc., Avon, MA (US)

(72) Inventor: Paul Osimo, Providence, RI (US)

(73) Assignee: Aqua-Leisure Industries, Inc., Avon, MA (US)

( * ) Notice: Subject to any disclaimer, the term of this patent is extended or adjusted under 35 U.S.C. 154(b) by 0 days.

(21) Appl. No.: 15/209,284

(22) Filed: Jul. 13, 2016

(65) Prior Publication Data

US 2017/0015393 A1 Jan. 19, 2017

Related U.S. Application Data

(60) Provisional application No. 62/193,364, filed on Jul. 16, 2015.

(51) Int. Cl.
*B63C 9/08* (2006.01)
*B63C 9/28* (2006.01)
*B63B 35/73* (2006.01)

(52) U.S. Cl.
CPC ..... *B63B 35/73* (2013.01); *A63B 2225/605* (2013.01); *A63B 2225/62* (2013.01)

(58) Field of Classification Search
CPC ..... B63B 35/58; B63B 35/73; B63B 35/74; B63B 2035/73; B63B 2035/737; A63B 2225/605; A63B 2225/62
USPC ..... 441/35, 40, 129; 114/345, 357
See application file for complete search history.

(56) References Cited

U.S. PATENT DOCUMENTS 3,056,980 A * 10/1962 Holladay ..... A47C 27/081 156/292
4,629,433 A * 12/1986 Magid ..... A47C 27/081 441/129
9,073,611 B2 * 7/2015 Berenson ..... B63B 35/78
2013/0323991 A1 * 12/2013 Berenson ..... B63C 9/08 441/108
2013/0323992 A1 * 12/2013 Berenson ..... A63H 23/00 441/131

* cited by examiner

*Primary Examiner* — Daniel V Venne
(74) *Attorney, Agent, or Firm* — Wolf, Greenfield & Sacks, P.C.

(57) ABSTRACT

This invention relates to recreational flotation devices, and particularly to floating mattresses or lounges, and to a method for manufacturing same.

12 Claims, 7 Drawing Sheets

10
20
22
12
30
16
24
14
26
20
30
12
22
12

14
17
18

RECREATIONAL FLOTATION DEVICE AND METHOD OF MANUFACTURING SAME

RELATED APPLICATIONS

This application claims priority under 35 U.S.C. § 119(e) to U.S. Provisional Patent Application Ser. No. 62/193,364, filed Jul. 16, 2015 and entitled "METHOD FOR MANUFACTURE OF FLOATING MATTRESS," which is incorporated herein by reference in its entirety for all purposes.

TECHNICAL FIELD

This invention relates to recreational flotation devices, and particularly to floating mattresses or lounges, and to a method for manufacturing same.

BACKGROUND

Recreational flotation devices, such as a floating mattress or lounge, are among the most popular beach and pool recreational devices. They are typically inflatable and may comprise one or more bladders or buoyant members located at the outer portions of the device, while an inner portion may consist of a layer of plastic or mesh material upon which the user sits or reclines, the inner portion being attached to the buoyant member or members. Some known mattresses comprise two buoyant members, one at each end of an elongated inner portion.

A known floating mattress, representative of the prior art, is shown in FIG. 1. It comprises an inner portion having a cylindrical buoyant member at each of two ends. Each buoyant member is substantially cylindrical in shape and includes a conventional inflation valve. The floating mattress illustrated in FIG. 1 is constructed as follows. Each buoyant member is comprised of three pieces of plastic material: circular end segments 1 and 3 and a tubular portion 2 formed by welding together the long edges of a single rectangular piece of material. A facing edge of an inner member 4 is sandwiched between and welded to the long edges of the of the tubular portion. The circular end segments 1 and 3 are then heat welded to each end of the tube 2.

The mattress shown in FIG. 1 requires six welding steps and requires the wastage of material that necessarily accompanies the cutting out of circular end segments.

Accordingly, there is a need for alternative articles and methods of manufacturing to reduce the amount of created waste material and/or to reduce the manufacturing steps required to make a recreational flotation device.

SUMMARY

Recreational flotation devices and methods for manufacturing the same are generally described.

According to one or more embodiments, a recreational flotation device is provided. The flotation device may comprise an inner member having a first end and a second end. The flotation device may further comprise a first buoyant member attached to the first end of the inner member. The first buoyant member may comprise a first sheet having a first and a second peripheral portion. The first buoyant member may further comprise a second sheet having a first and a second peripheral portion. The first buoyant member may further comprise a single welding seam fusing the first peripheral portions of the first and second sheets, and further fusing the second peripheral portions of the first and second sheets and the first end of the inner member. The flotation device may further comprise a second buoyant member attached to the second end of the inner member. The second buoyant member may comprise a first sheet having a first and a second peripheral portion. The second buoyant member may further comprise a second sheet having a first and a second peripheral portion. The second buoyant member may further comprise a single welding seam fusing the first peripheral portions of the first and second sheets, and further fusing the second peripheral portions of the first and second sheets and the second end of the inner member.

According to one or more embodiments, a method of manufacturing a recreational flotation device is provided. The recreational flotation device may comprise a first buoyant member and a second buoyant member attached to an inner member. The method may comprise aligning first and second peripheral portions of a first sheet with first and second peripheral portions of a second sheet. The method may further comprise positioning a first end of the inner member between the second peripheral portions of the first and second sheets. The method may further comprise welding the first sheet to the second sheet to form the first buoyant member, such that the formed first buoyant member comprises a continuous welding seam continuing between the first peripheral portions of the first and second sheets and between the second peripheral portions of the first and second sheets and the first end of the inner member, thereby attaching the first and second sheets to each other and to the first end of the inner member. The method may further comprise aligning first and second peripheral portions of a third sheet with first and second peripheral portions of a fourth sheet. The method may further comprise positioning the second end of the inner member between the second peripheral portions of the third and fourth sheets. The method may further comprise welding the third sheet to the fourth sheet to form the second buoyant member, such that the formed second buoyant member comprises a continuous welding seam continuing between the first peripheral portions of the third and fourth sheets and between the second peripheral portions of the third and fourth sheets and the second end of the inner member, thereby attaching the third and fourth sheets to each other and to the second end of the inner member.

Other advantages and novel features of the present invention will become apparent from the following detailed description of various non-limiting embodiments of the invention when considered in conjunction with the accompanying figures. In cases where the present specification and a document incorporated by reference include conflicting and/or inconsistent disclosure, the present specification shall control.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Recreational flotation devices and methods for manufacturing the same are generally described. The instant disclosure provides a simpler, more economical, yet effective method of constructing a flotation device, and particularly a floating mattress, such as one of the type having two buoyant members, one at each end of an elongated inner member. Currently, such mattresses are manufactured by a welding technique that requires six welds, three at each end of the flotation device, so as to form the buoyant members and secure them to the inner portion, as described in the background section above. The method of the instant disclosure reduces the construction to a single weld at each end, resulting not only in time-saving but in a reduction in materials needed to manufacture the floating mattress. To make the disclosed flotation device, the edge of the inner member is sandwiched between the corresponding edges of the plastic pieces so that the buoyant member is formed and secured to the inner portion in one step. Thus the entire floating mattress is formed in two welding steps, one at each end.

Not only does the new method disclosed here save time in assembling the lounge, but it eliminates the wastage of material that necessarily accompanies the cutting out of the circular end segments of the prior art device.

Figure 1:
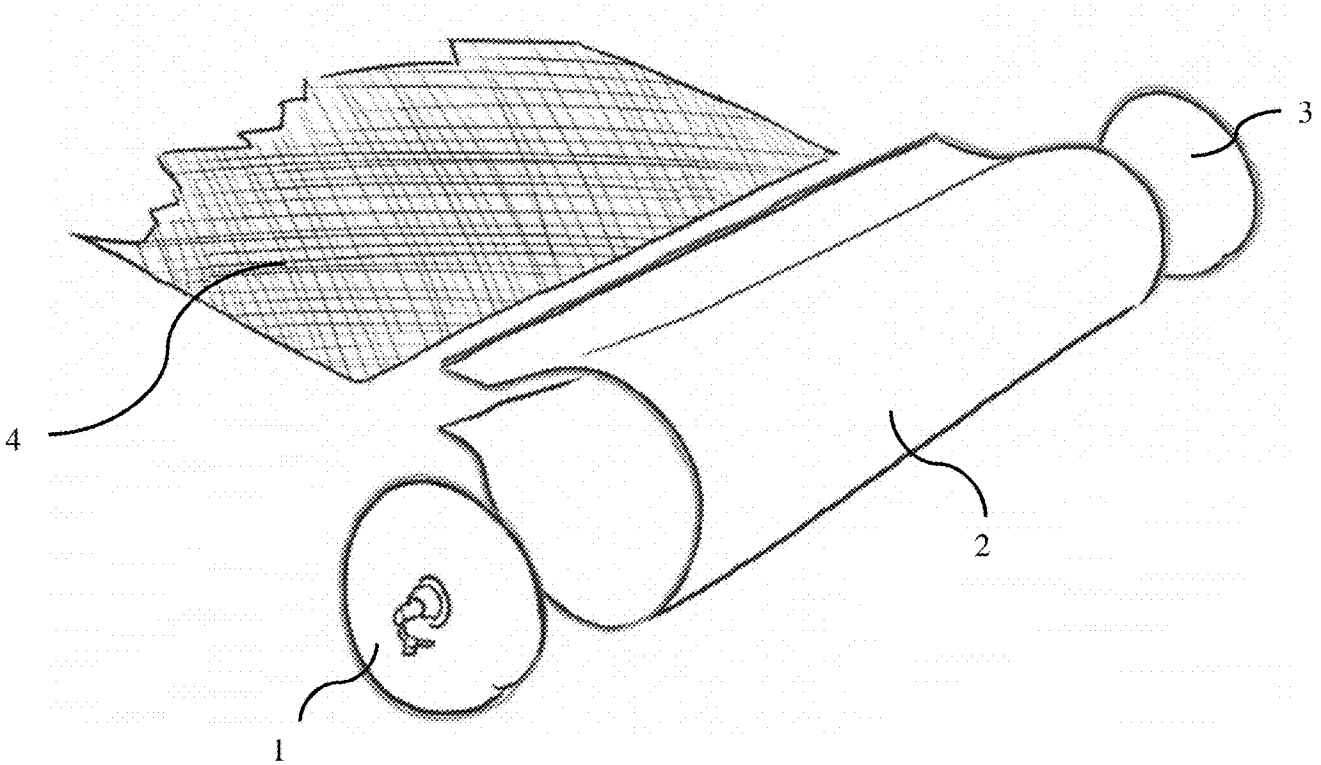
(PRIOR ART) FIG. 1
FIG. 1 is a drawing illustrating and describing the construction method by which a flotation device in the prior art was made.
Figure 2:
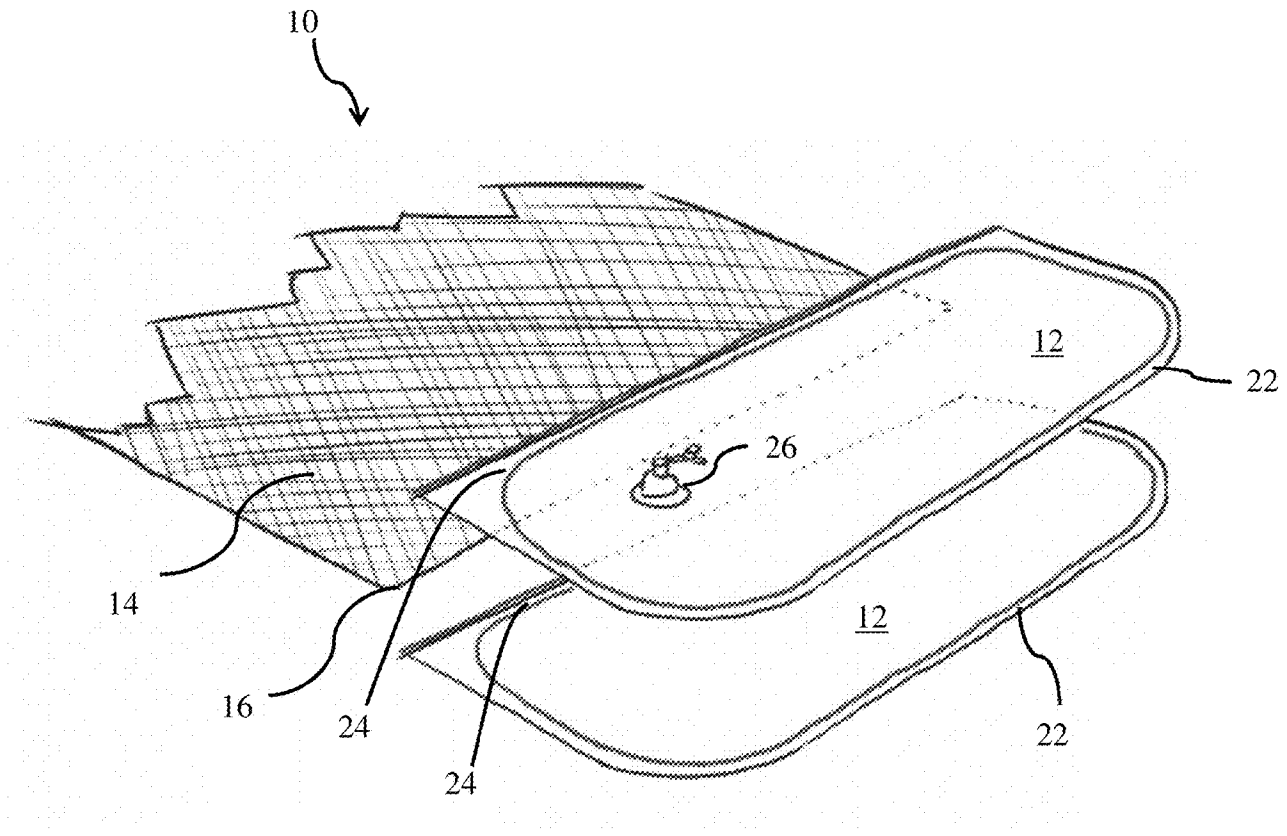
FIG. 2 is a drawing illustrating and describing the construction method for a flotation device, according to one or more embodiments.

According to one or more embodiments, a method of manufacturing a recreational flotation device comprising first and second buoyant members attached to an inner member is provided. FIG. 2 is a drawing illustrating a construction method for the flotation device 10 shown in the following FIGS. 3A-7. Each buoyant member 20 (shown in FIG. 3A) comprises two sheets 12. Each sheet 12 comprises a periphery. The periphery of each sheet may be thought of as having a first portion 22, referred to as a first peripheral portion 22, and a second portion 24, referred to as a second peripheral portion 24. The first peripheral portions 22 are the portions of sheets 12 that are welded directly to one another. The second peripheral portions 24 are the portions of sheets 12 that are welded to one another with an end 16 of an inner member 14 positioned between them. The sheets 12 may be formed from plastic and may include an inflation valve 26.

According to one or more embodiments, as part of the method of manufacturing, the two sheets 12 that are to form a buoyant member 20 are aligned with one another. For example, the first and second peripheral portions 22 and 24 of a first sheet 12 are aligned with the first and second peripheral portions 22 and 24 of a second sheet 12, as shown in FIG. 2. Alignment may occur by laying one sheet 12 on top of the other sheet 12.

The first end 16 of the inner member 14 may be positioned between the second peripheral portions 24 of the first and second sheets 12, also shown in FIG. 2. Such a positioning results in a sheet-end-sheet layering configuration.

Figures 3A, 3B:
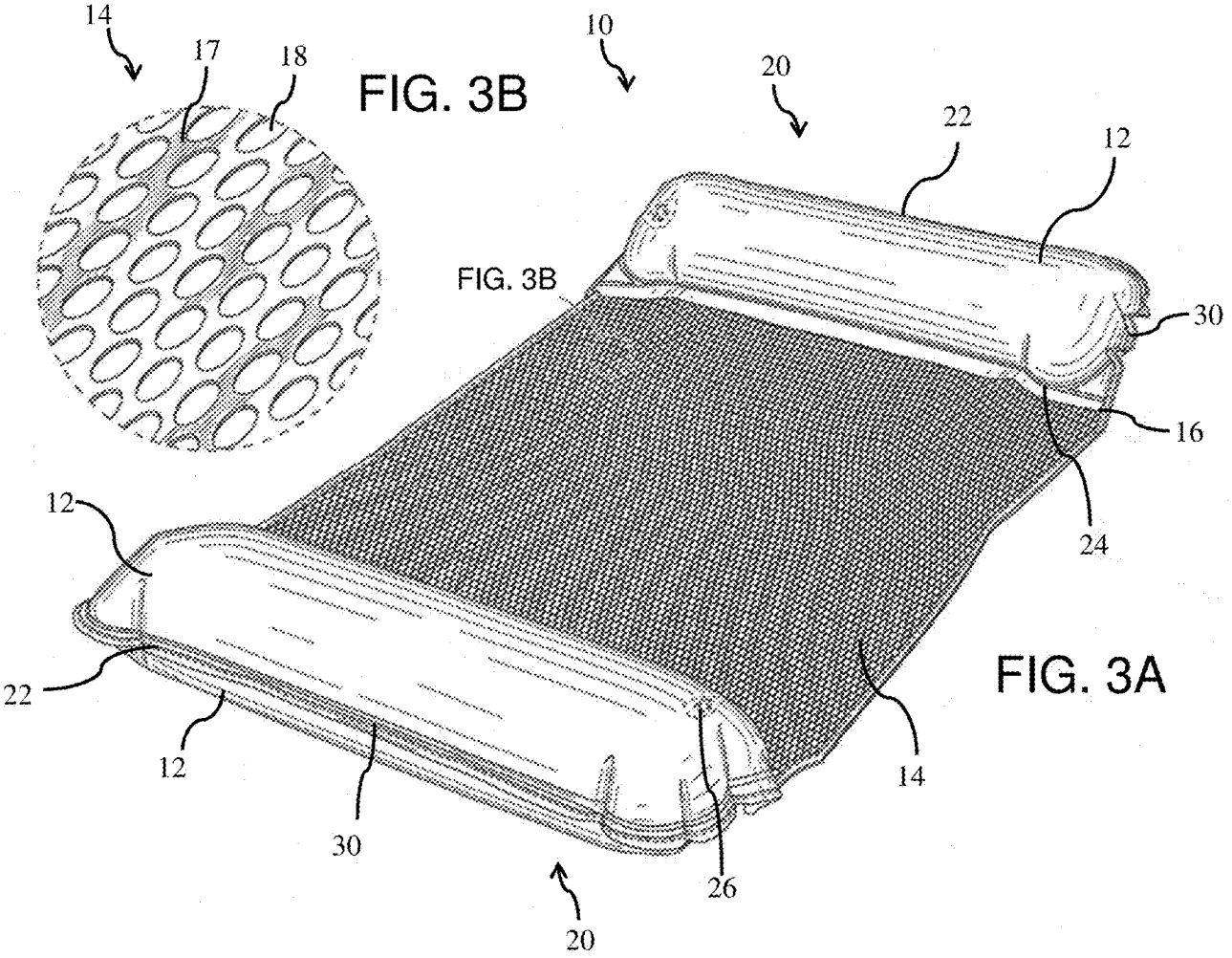
FIG. 3A is a perspective view of a flotation device, according to one or more embodiments.
FIG. 3B is a detail view of a section of a mesh portion of the flotation device shown in FIG. 3A, according to one or more embodiments.

The first sheet 12 may be welded to the second sheet 12 to form the buoyant member 20 (shown in FIG. 3A). The sheets 12 may be welded together at their outer peripheries by any conventional heat welding technique. The entire peripheries (first portions 22 and second portions 24) of the two sheets 12 along with the end 16 of the inner member 14 may be welded together in a single welding step, which would be understood to include welding operations where the welding implement is temporality removed from the seam and then returned to it. The step of welding may be performed such that the formed buoyant member 20 comprises a continuous welding seam 30 continuing between the first peripheral portions 22 of the first and second sheets 12 and between the second peripheral portions 24 of the first and second sheets 12 and the first end 16 of the inner member 14. In other words, the welding step may form a welding seam 30 that surrounds the entire peripheries of the sheets 12 including the periphery portions 24 sandwiching the end 16 of the inner member 14. In such a manner, the first and second sheets 12 may be attached to each other and to the first end 16 of the inner member 14.

While not shown in FIG. 2, a second buoyant member 20 (shown in FIG. 3A) may be formed and attached to an end 16 of the inner member 14 following a similar process of aligning, positions, and welding, described above with regard to the first buoyant member 20.

FIGS. 3A-7 show a flotation device 10 made by the method described above shown from various views. FIG. 3A is a perspective view of a flotation device 10, according to one or more embodiments. The flotation devices comprises two inflatable, buoyant members 20 attached at the ends 16 of an inner member 14. The inner member 14 may be an elongated mesh member. The buoyant members 20 may be constructed of an air-impermeable material. They may be constructed of plastic such as a laminated PVC, and each may include a conventional inflation valve 26.

FIG. 3B is a detail view of a section of the inner member 14 of the flotation device 10 shown in FIG. 3A, according to one or more embodiments. The inner portion may be constructed from any suitable plastic, such as HD MESH as shown in FIG. 3B. According to certain embodiments, the inner portion comprises a mesh material 17 defining a plurality of apertures 18.

The recreational flotation device shown in FIGS. 3A and 4-7 comprises an inner member 14 and first and second buoyant members 20. The two buoyant members 20 may be substantially the same shape and size. The inner member 14 has first and second ends 16. The first buoyant member 20 is attached to the first end 16 of the inner member 14. And the second buoyant member 20 is attached to the second end 16 of the inner member 14. It is immaterial which of the two buoyant members 20 is considered to be the first buoyant member 20. Likewise, it is immaterial which of the two ends 16 of the inner member 14 is considered to be the first end 16.

Each of the buoyant members 20 comprises first and second sheets 12. As shown, the two buoyant members 20 are spaced apart from one another by the inner member 14. As shown, the first sheet 12 of the second buoyant member 20 is separate and distinct from the first and second sheets 12 of the first buoyant member 20. Likewise, the second sheet 12 of the second buoyant member 20 is also separate and distinct from the first and second sheets 12 of the first buoyant member. In some embodiments, the sheets 12 may be substantially identical in size and shape. At least one of the sheets 12 may have an inflation valve 26. Each of the sheets 12 has a periphery. The periphery may be thought of as having two portions—a first peripheral portion 22 where the two sheets 12 are attached directly to each other, and a second peripheral portion 24 where the sheets 12 sandwich an end 16 of the inner member 14, and are attached to each other and the inner member 14.

Each of the buoyant members 20 further comprises a single welding seam 30 fusing the first peripheral portions 22 of the first and second sheets 12, and further fusing the second peripheral portions 24 of the first and second sheets 12 and the first end 16 of the inner member 14. In other words, each of the buoyant members 20 comprises a welding seam 30 surrounding the entire periphery of the first and second sheets 12, including the peripheral portions 24 of the sheets 12 sandwiching the end 16 of the inner member 14.

FIGS. 4-7 show additional alternative views of the embodiment shown in FIG. 3A.

Figure 4:
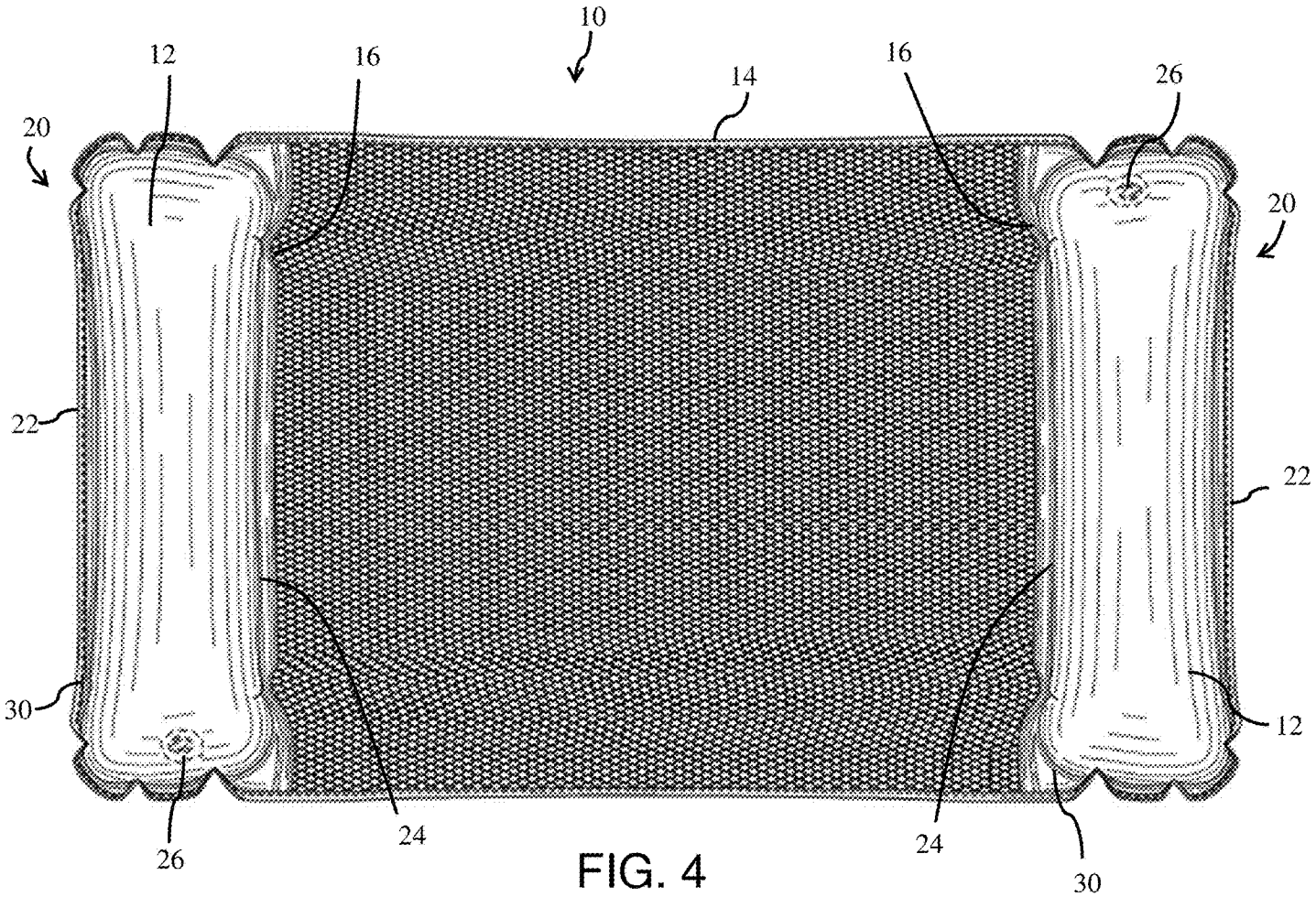
FIG. 4 is a top plan view of the flotation device shown in FIG. 3A, according to one or more embodiments.
Figure 5:
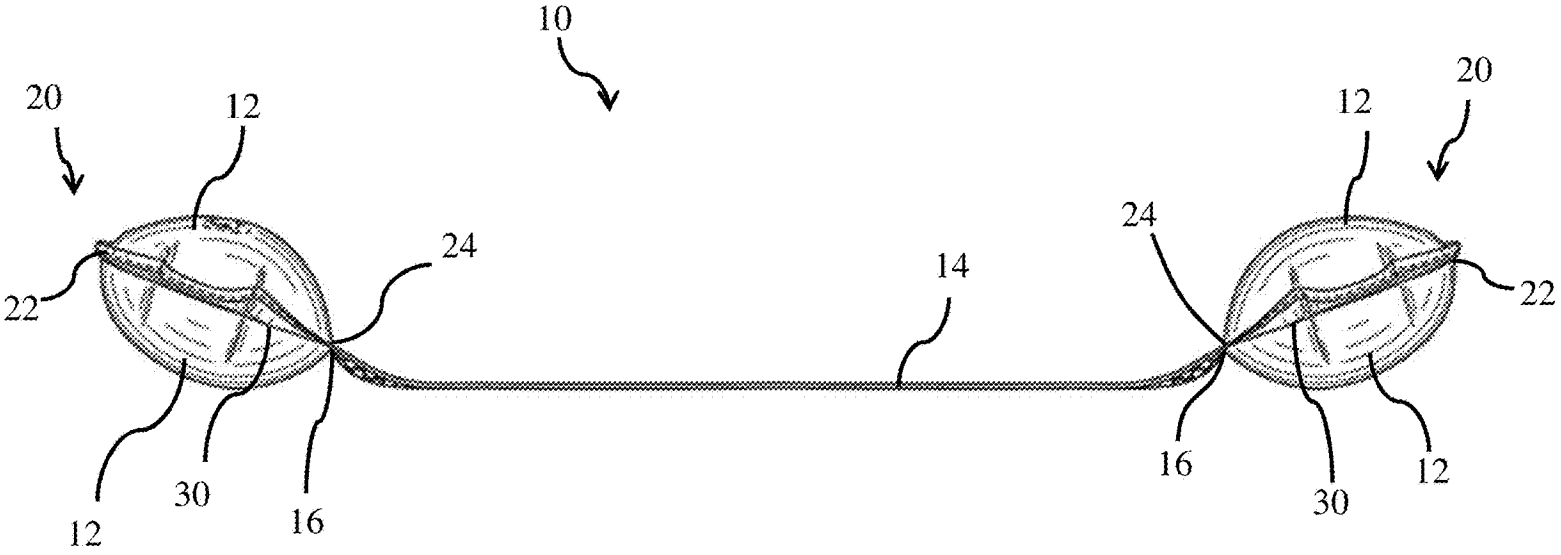
FIG. 5 is an elevation view of the flotation device shown in FIG. 3A as seen from the right side of FIG. 3A, the left side elevation view being identical, according to one or more embodiments.
Figure 6:
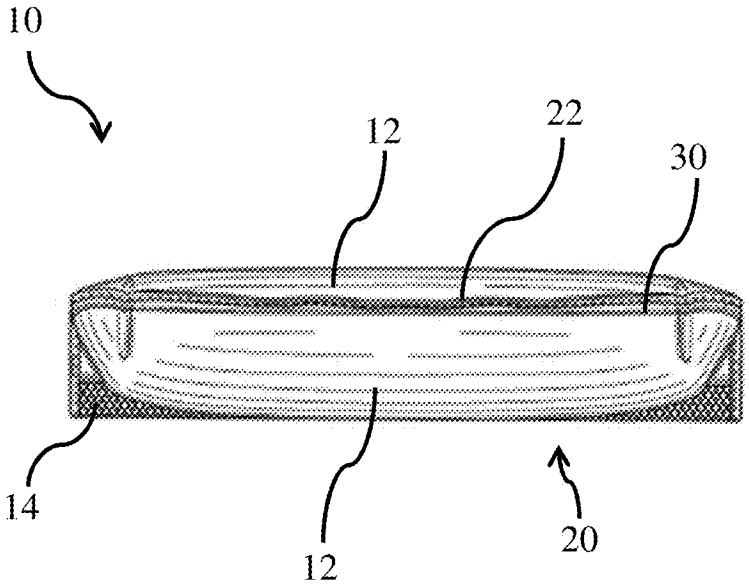
FIG. 6 is an elevation view of the flotation device shown in FIG. 3A as seen from the front end of FIG. 3A, the rear end elevation view being identical, according to one or more embodiments.
Figure 7:
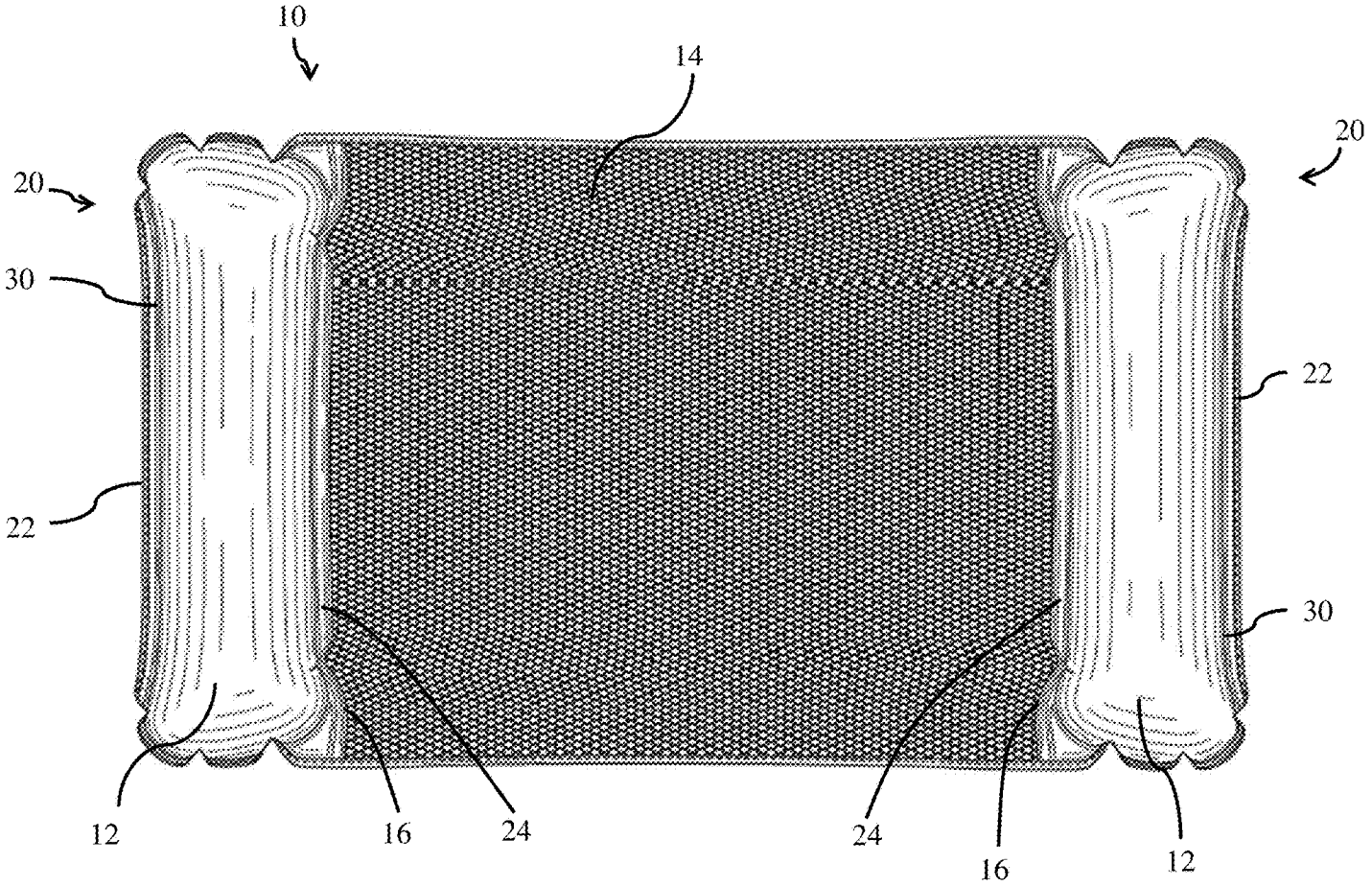
FIG. 7 is a bottom plan view of the flotation device shown in FIG. 3A, according to one or more embodiments.

FIG. 4 is a top plan view of the flotation device shown in FIG. 3A, according to one or more embodiments. FIG. 5 is an elevation view of the flotation device shown in FIG. 3A as seen from the right side of FIG. 3A, the left side elevation view being identical, according to one or more embodiments. FIG. 6 is an elevation view of the flotation device shown in FIG. 3A as seen from the front end of FIG. 3A, the rear end elevation view being identical, according to one or more embodiments. FIG. 7 is a bottom plan view of the flotation device shown in FIG. 3A, according to one or more embodiments.

According to at least one alternative embodiment of the flotation device, each of the buoyant members may comprise a single sheet folded over, with edge portions of the folded over sheet sandwiching an end of the inner member. The sheet is then welded along the folded over edges, including the portion sandwiching the end of the inner member, to simultaneously form a buoyant member and attach the buoyant member to the inner member. The resulting buoyant member comprises a single sheet and a single welding seam extending around the periphery of the folded portion of the sheet, including the portion sandwiching an end of the inner member.

From the description of at least one embodiment of the present disclosure, various alternations, modifications and improvements will readily occur to those skilled in the art. Such alterations, modifications and improvements are intended to be within the scope and spirit of the disclosure. Accordingly, the foregoing description is by way of example only and is not intended to be limiting.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present invention.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A recreational flotation device, comprising:

an inner member having a first end and a second end;

a first buoyant member attached to the first end of the inner member, the first buoyant member comprising:

a first sheet having a first and a second peripheral portion;

a second sheet having a first and a second peripheral portion; and a single welding seam fusing the first peripheral portions of the first and second sheets, and further fusing the second peripheral portions of the first and second sheets and the first end of the inner member, wherein the first end of the inner member is positioned between the second peripheral portions of the first and second sheets of the first buoyant member; and a second buoyant member attached to the second end of the inner member, the second buoyant member comprising:

a first sheet, separate and distinct from the first and second sheets of the first buoyant member, having a first and a second peripheral portion;

a second sheet, separate and distinct from the first and second sheets of the first buoyant member, having a first and a second peripheral portion; and a single welding seam fusing the first peripheral portions of the first and second sheets, and further fusing the second peripheral portions of the first and second sheets and the second end of the inner member, wherein the second end of the inner member is positioned between the second peripheral portions of the first and second sheets of the second buoyant member.

2. The recreational flotation device of claim 1, wherein each of the first buoyant member and the second buoyant member comprises an air-impermeable material.

3. The recreational flotation device of claim 1, wherein each of the first buoyant member and the second buoyant member comprises PVC.

4. The recreational flotation device of claim 1, wherein the first sheet of the first buoyant member and the second sheet of the first buoyant member are substantially the same shape and size.

5. The recreational flotation device of claim 1, wherein the first sheet of the second buoyant member and the second sheet of the second buoyant member are substantially the same shape and size.

6. The recreational flotation device of claim 1, wherein the first end of the inner member is positioned between the first peripheral portion of the first sheet of the first buoyant member and the first peripheral portion of the second sheet of the first buoyant member.

7. The recreational flotation device of claim 1, wherein the second end of the inner member is positioned between the first peripheral portion of the first sheet of the second buoyant member and the first peripheral portion of the second sheet of the second buoyant member.

8. The recreational flotation device of claim 1, wherein the first buoyant member further comprises an inflation valve positioned in the first sheet of the first buoyant member.

9. The recreational flotation device of claim 1, wherein the second buoyant member further comprises an inflation valve positioned in the first sheet of the second buoyant member.

10. The recreational flotation device of claim 1, wherein the inner member comprises a mesh material.

11. A method of manufacturing a recreational flotation device comprising a first buoyant member and a second buoyant member attached to an inner member, the method comprising:

aligning first and second peripheral portions of a first sheet with first and second peripheral portions of a second sheet;

positioning a first end of the inner member between the second peripheral portions of the first and second sheets;

welding the first sheet to the second sheet to form the first buoyant member, such that the formed first buoyant member comprises a continuous welding seam continuing between the first peripheral portions of the first and second sheets and between the second peripheral portions of the first and second sheets and the first end of the inner member, thereby attaching the first and second sheets to each other and to the first end of the inner member;

aligning first and second peripheral portions of a third sheet with first and second peripheral portions of a fourth sheet;

positioning the second end of the inner member between the second peripheral portions of the third and fourth sheets; and welding the third sheet to the fourth sheet to form the second buoyant member, wherein the second buoyant member is spaced apart from the first buoyant member, such that the formed second buoyant member comprises a continuous welding seam continuing between the first peripheral portions of the third and fourth sheets and between the second peripheral portions of the third and fourth sheets and the second end of the inner member, thereby attaching the third and fourth sheets to each other and to the second end of the inner member.

12. The method of claim 11, wherein the inner member comprises a mesh material.

* * * * *